US008038023B2

(12) United States Patent
Moore et al.

(10) Patent No.: US 8,038,023 B2
(45) Date of Patent: Oct. 18, 2011

(54) MOLDED CONTAINER WITH DEGASSING VALVE

(75) Inventors: Grey Moore, Florence, SC (US); Robert Thor Versluys, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 226 days.

(21) Appl. No.: 12/124,219

(22) Filed: May 21, 2008

(65) Prior Publication Data

US 2009/0289073 A1 Nov. 26, 2009

(51) Int. Cl.
*B65D 90/22* (2006.01)
*B65D 90/36* (2006.01)

(52) U.S. Cl. ..... 220/89.2; 220/913; 220/745; 220/89.1; 220/DIG. 27

(58) Field of Classification Search ..... 220/745, 220/89.2, 913, DIG. 27, 746, 747, 89.1; 215/11.5, 215/12.1; 137/246, 859, 855
See application file for complete search history.

(56) References Cited

U.S. PATENT DOCUMENTS

| | | | | |
|---|---|---|---|---|
| 1,854,518 | A | 4/1932 | Little | |
| 2,880,744 | A * | 4/1959 | Daley, Jr. | 137/197 |
| 2,946,502 | A | 7/1960 | Metzger | |
| 3,384,113 | A | 5/1968 | Pennisi | |
| 3,432,070 | A * | 3/1969 | Dubois et al. | 220/62.22 |
| 3,622,439 | A * | 11/1971 | Manne et al. | 428/414 |
| 4,206,870 | A | 6/1980 | DeVries | |
| 4,690,295 | A * | 9/1987 | Wills | 220/590 |
| 4,890,637 | A | 1/1990 | Lamparter | |
| 5,326,176 | A * | 7/1994 | Domke | 383/103 |
| 5,342,093 | A * | 8/1994 | Weernink | 283/81 |
| 5,462,180 | A * | 10/1995 | Bright | 215/12.1 |
| 5,495,944 | A * | 3/1996 | Lermer | 206/459.1 |
| 5,584,409 | A * | 12/1996 | Chemberlen | 220/89.1 |
| 5,944,205 | A * | 8/1999 | LaJoie et al. | 215/11.5 |
| 6,056,439 | A | 5/2000 | Graham | |
| 6,171,623 | B1 * | 1/2001 | Gaylor et al. | 426/117 |

(Continued)

FOREIGN PATENT DOCUMENTS

EP 1 340 695 A1 9/2003

(Continued)

OTHER PUBLICATIONS

International Search Report for PCT/US2009/043937 mailed Jul. 13, 2009.

*Primary Examiner* — Mickey Yu
*Assistant Examiner* — Kareen Rush
(74) *Attorney, Agent, or Firm* — Alston & Bird LLP

(57) ABSTRACT

A molded plastic container includes a side wall having a valve seat feature molded into the side wall, the valve seat feature comprising a central recess in the outer surface of the side wall, and an annular valve seat surrounding the central recess. The container has one or more holes extending through a portion of the side wall bounded by the annular valve seat into the interior of the container for venting gas from the container. A label is affixed against the outer surface of the side wall and is under tension, the tension of the label causing the label to firmly abut the annular valve seat. Excess pressure of gas inside the container is able to momentarily lift the label away from the annular valve seat to establish a flow path between the label and the annular valve seat such that gas under pressure is vented from the container.

19 Claims, 2 Drawing Sheets

U.S. PATENT DOCUMENTS

| | | | | |
|---|---|---|---|---|
| 6,261,615 | B1 * | 7/2001 | Sumpmann et al. | 426/106 |
| 6,296,129 | B1 * | 10/2001 | Kawasaki | 215/12.1 |
| 6,554,146 | B1 * | 4/2003 | DeGroff et al. | 215/381 |
| 6,581,972 | B2 * | 6/2003 | Nojima et al. | 283/81 |
| 6,648,167 | B1 * | 11/2003 | Brupbacher et al. | 220/586 |
| 6,662,827 | B1 * | 12/2003 | Clougherty et al. | 137/859 |
| 6,767,604 | B2 * | 7/2004 | Muir et al. | 428/40.1 |
| 7,198,070 | B1 * | 4/2007 | Hansen et al. | 141/3 |
| 7,294,354 | B2 * | 11/2007 | Gunter et al. | 426/118 |
| 7,316,797 | B2 * | 1/2008 | Tanaka et al. | 264/512 |
| 7,448,153 | B2 * | 11/2008 | Maliner et al. | 40/310 |
| 7,490,623 | B2 * | 2/2009 | Rypstra | 137/246 |
| 2004/0000336 | A1 | 1/2004 | Goglio | |
| 2004/0173626 | A1 | 9/2004 | Jeor | |
| 2005/0072480 | A1 | 4/2005 | Brandes | |
| 2005/0103798 | A1 | 5/2005 | Luigi | |
| 2006/0076058 | A1 * | 4/2006 | Rypstra | 137/246 |
| 2006/0096982 | A1 | 5/2006 | Gunter et al. | |
| 2007/0191807 | A1 * | 8/2007 | Hayashi et al. | 604/385.28 |
| 2007/0269145 | A1 | 11/2007 | Eisenbarth | |
| 2008/0020328 | A1 * | 1/2008 | Sugeta et al. | 430/327 |

FOREIGN PATENT DOCUMENTS

| | | | |
|---|---|---|---|
| JP | 2003-221078 | A | 8/2003 |

* cited by examiner

MOLDED CONTAINER WITH DEGASSING VALVE

BACKGROUND OF THE INVENTION

This invention relates to containers for products that tend to release gases after filling and sealing of the containers, and relates in particular to containers having a gas release vent or valve for releasing excessive gases built up within the container.

Some products, such as freshly roasted and ground coffee or yeast dough, tend to give off gases for a period of time after their preparation. For instance, when coffee that has been freshly roasted is ground, the coffee releases carbon dioxide and other gaseous substances for days or weeks. Similarly, freshly prepared yeast dough also releases carbon dioxide for a substantial period of time. In the case of ground coffee, because of the gas release, also known as off-gassing, it has customarily been the practice to store the freshly ground coffee for some time so that the majority of the off-gassing occurs before packaging the coffee, so as to avoid the sealed coffee packages being deformed or even failing as a result of the build-up of gas pressure in the packages. However, it has also been recognized that storing the ground coffee prior to packaging potentially can result in the loss of some beneficial aromatic and flavor compounds from the coffee.

Accordingly, containers have been developed that have provisions for releasing excess gas pressure from the containers so that an off-gassing product can be immediately packaged. In the case of ground coffee, this can help reduce the loss of desirable aromatic or flavor components. The prior art exhibits two basic approaches to the problem of relieving excessive gas pressure from containers for off-gassing products such as coffee or dough. One approach is exemplified by flexible coffee bags such as those described in U.S. Pat. No. 3,595,467 to Goglio, U.S. Pat. No. 5,326,176 to Domke, and U.S. Pat. No. 5,992,635 to Walters. The bags are produced from flexible web materials having gas-barrier properties. A one-way gas release valve is provided in the flexible web material. The valve allows gas to escape from the bag when the gas pressure becomes excessive, but substantially prevents air from entering the bag through the valve. Such flexible coffee bags can be prone to malfunctioning of the valve as a result of wrinkling or other deformation of the flexible material. Additionally, the bags generally are reclosable only by rolling the top of the bag down and securing the top in the rolled position using an attached wire strip or the like. Such reclosing mechanisms are inconvenient to use, and the wire strips often become detached.

The other basic approach in the prior art to the problem of relieving excessive gas pressure from containers for off-gassing products is exemplified by rigid or semi-rigid containers such as those described in U.S. Pat. No. 5,515,994 to Goglio and U.S. Pat. No. 6,733,803 to Vidkjaer. The rigid or semi-rigid containers of these patents include a flange on the upper edge of the container wall to provide a relatively large sealing surface for the attachment of a flexible membrane lid to seal the container closed. A one-way gas release valve is provided in the flexible membrane lid for relieving excessive gas pressure. Such membrane lids with gas release valves generally must be conduction heat-sealed to the flange, which is a relatively slow process. A further drawback to containers of this type arises when a replaceable overcap is included for reclosing the container after the membrane lid is removed. Because excess gas is vented through the valve in the membrane lid, the overcap or its attachment to the container must also include a provision to vent the gas, or else the overcap could prevent the valve from fulfilling its intended function. Such venting provision in the overcap may at least partially negate the resealing function of the overcap unless special steps are taken to design the venting provision in such a way that it functions to vent the released gases but does not allow air to enter the container after replacement of the overcap.

Existing one-way degassing valves are often complicated in construction and relatively expensive. The desire is to produce an effective degassing valve for a rigid package such as a thermoformed or blow-molded plastic container, at a low cost.

BRIEF SUMMARY OF THE INVENTION

The present invention addresses the above-noted shortcomings of prior gas release containers and achieves other advantages, by providing a molded plastic container having a container body comprising a side wall encircling an axis, the side wall having an outer surface and an inner surface and having a valve seat feature molded into the side wall, the valve seat feature comprising a central recess in the outer surface of the side wall, and an annular valve seat surrounding the central recess. The valve seat feature can include an annular recess surrounding the central recess, such that the annular valve seat is defined between the central and annular recesses. The container has one or more holes extending through a portion of the side wall bounded by the annular valve seat into the interior of the container for venting gas from the container. A label is affixed against the outer surface of the side wall and is under tension, the tension of the label causing the label to firmly abut the annular valve seat. Excess pressure of gas inside the container is able to momentarily lift the label away from the annular valve seat to establish a flow path between the label and the annular valve seat such that gas under pressure is vented through the one or more holes and through the flow path, after which the tension of the label causes the label to reengage the annular valve seat to close the degassing valve.

The container body advantageously is a generally rigid or semi-rigid structure, as distinguished from flexible coffee bags or the like, and can be formed entirely or at least substantially entirely of polymer material(s). In some embodiments of the invention, the container body comprises a blow-molded can, which can be formed by extrusion blow molding, injection stretch-blow molding, or the like. Alternatively, the container body can be formed by thermoforming a polymer sheet.

The valve seat feature can include one or more channels in the outer surface of the side wall leading radially outward from the annular valve seat.

In some embodiments of the invention, silicone oil can be disposed between the label and the valve seat feature to aid in sealing the degassing valve.

Optionally, at least that portion of the label overlying the valve seat feature can include an oxygen barrier material. In one embodiment, the oxygen barrier material is pattern-applied to the label in a region approximately the same size as the valve seat feature, such that the majority of the label does not have the oxygen barrier material. The label is positioned about the side wall of the container body such that the coating of oxygen barrier material is in registration with the valve seat feature. The oxygen barrier material can be slightly tacky and disposed on the surface of the label against the side wall such that it slightly adheres to the outer surface of the side wall to improve performance of the degassing valve. Various oxygen barrier materials can be used, such as polyvinyl alcohol copolymer (PVOH), polyvinylidene chloride (PVDC), epoxy, ethylene vinyl alcohol copolymer (EVOH), or the like.

In one embodiment of the invention, the label includes a pattern-applied coating of a heat-sealable material in registration with the valve seat feature. The heat-sealable material is heat-sealed to the outer surface of the side wall so as to form one or more channels for guiding the gas vented from the container.

The side wall of the container body can have any of various cross-sectional shapes, including round or non-round shapes. When the label includes a pattern-applied material in a localized region of the label, registration of such region with the valve seat feature is facilitated by making the container body non-round.

The label in some embodiments of the invention comprises a heat-shrink sleeve that is sleeved over the side wall and heated to shrink the sleeve about the side wall. The heat-shrink sleeve can include a seam that extends generally longitudinally along the sleeve. The sleeve is positioned on the container body such that the seam is proximate to but circumferentially spaced from the valve seat feature. For example, the seam can be circumferentially spaced about 10 to 20 mm (about 0.5 to 0.75 inch) from the valve seat feature.

In another aspect of the invention, a method for making a container having a degassing valve comprises the steps of: (a) molding a container body from polymer material, the container body having a side wall encircling an axis and having an outer surface and an inner surface; (b) forming a valve seat feature in the side wall during the molding step, the valve seat feature comprising a central recess in the outer surface of the side wall, and an annular valve seat surrounding the central recess; (c) forming one or more holes through the side wall in the central recess; (d) positioning a label encircling the outer surface of the side wall, the label and the valve seat feature forming the degassing valve; and (e) causing the label to be under tension that urges the label firmly against the annular valve seat so as to close the degassing valve, such that excess pressure of gas inside the container is able to momentarily lift the label away from the annular valve seat to establish a flow path between the label and the annular valve seat such that the degassing valve is opened and the excess pressure is vented through the one or more holes and through the flow path, after which the tension of the label causes the label to reengage the annular valve seat to close the degassing valve.

The molding step comprises forming the container body in a mold having an inner surface a region of which is configured for forming the valve seat feature in the side wall when the polymer material conforms to the inner surface of the mold.

In one embodiment, the step of forming the one or more holes in the side wall comprises laser-perforating the side wall.

The method can include the step of applying silicone oil to the valve seat feature just prior to positioning the label about the side wall.

In one embodiment of the invention, the label includes a pattern-applied coating of an oxygen barrier material covering a region of the label approximately the size of the valve seat feature, and the step of positioning the label is carried out such that the coating of the oxygen barrier material is in registration with the valve seat feature.

In accordance with one embodiment, the label comprises a heat-shrink sleeve, and the step of causing the label to be under tension comprises heating the sleeve to cause the sleeve to shrink about the side wall.

An opening pressure of the degassing valve can be selected to be a desired value by adjusting either or both of the amount of tension in the label and a diameter of the valve seat feature.

In one embodiment of the invention, the label includes a pattern-applied coating of a heat-sealable material covering a region of the label approximately the size of the valve seat feature, and the step of positioning the label is carried out such that the coating of the heat-sealable material is in registration with the valve seat feature. The heat-sealable material is heat sealed to the outer surface of the side wall so as to form one or more channels between the label and the outer surface of the side wall for guiding the gas vented from the container.

The container can be filled through an open end of the container body with a product that tends to release gases, and a closure can be applied to the open end of the container body to seal the product in the container.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
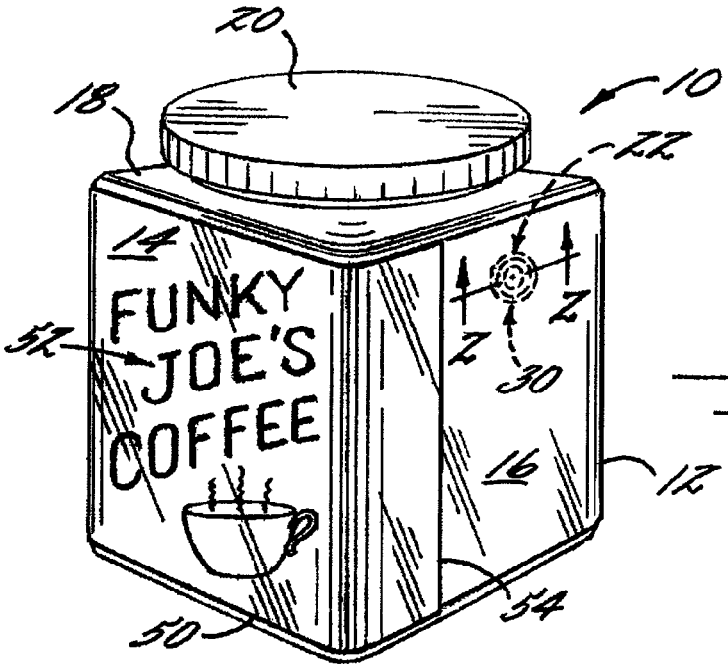
FIG. 1 is a perspective view of a container in accordance with one embodiment of the invention.

A container 10 in accordance with one embodiment of the invention is illustrated in FIG. 1. The container has a container body 12 formed of moldable material such as thermoplastic polymer. The container body can be produced by various processes including injection molding, thermoforming, blow molding, injection stretch-blow molding, or the like. The container body in the illustrated embodiment has a generally square or rectangular cross-sectional shape. A side wall of the container body thus has four generally square or rectangular panels (two panels 14 and 16 being visible in FIG. 1) that join one another at four corners of the container body. A bottom wall (not visible in FIG. 1) is joined to the lower edges of the four panels. The illustrated container body shape is only exemplary, and various other shapes can be used, including round, oval, elliptical, triangular, etc.

The container defines a top opening through which the product stored in the container is accessible. As shown, the container body 12 can include an upper shoulder 18 that joins to a neck of reduced diameter relative to the main portion of the side wall. The neck defines the top opening. A closure 20 is removably joined to the neck to close the container. For example, the neck can define threads that are engaged by cooperating threads in the closure 20. Alternatively, the neck and closure can be configured such that the closure forms a snap fit with the neck. The container can include a membrane (not shown) that is heat-sealed to the top surface of the neck for initial sealing of the container, and that is peeled off upon initial opening and is discarded, the closure 20 then being used for reclosing the container. Such a membrane can be integrated with the closure 20. Various other closure systems can be used.

The container 10 includes a degassing valve 22 for releasing gas under pressure that has built up within the sealed container. The degassing valve 22 is shown as being provided in the side wall panel 16 of the container of FIG. 1, although the particular location of the valve is not critical. The degassing valve is formed in part by a valve seat feature 30 that is formed in the side wall of the container body 12 during the molding of the container body. The valve also includes a label 50 that is sleeved about the container body 12 and is under tension such that the label presses radially inwardly against the outer surfaces of the container body. The label can comprise a heat-shrink film in some embodiments. The label can be printed with indicia and graphics 52.

Figure 2:
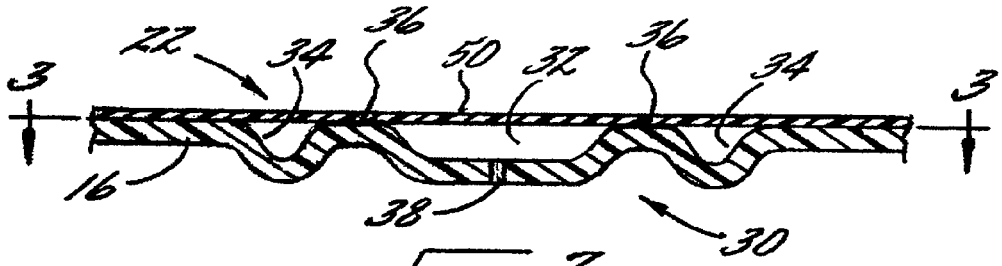
FIG. 2 is a cross-sectional view through the side wall of the container in the region of the degassing valve, along line 2-2 in FIG. 1.
Figure 3:
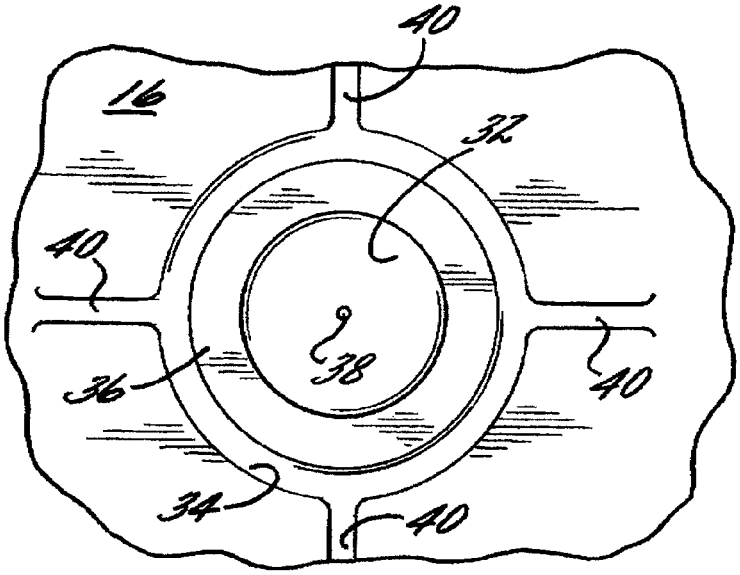
FIG. 3 is a view of the container side wall along line 3-3 in FIG. 2.

With reference to FIGS. 2 and 3, the degassing valve 22 is shown in detail. The side wall panel 16 is molded to include the valve seat feature 30. The valve seat feature includes a central recess or depression 32 in the outer surface of the panel 16. The central recess can be round, non-round, etc. Surrounding the central recess and radially spaced outwardly therefrom ("radially" in this case being relative to the center of the central recess 32, in a direction lying in the plane of the panel 16) is an annular recess 34 formed in the outer surface of the panel 16. Lying radially between the annular recess 34 and the central recess 32 is an annular valve seat 36 that is generally in the same plane as the portions of the panel 16 lying outside of and surrounding the valve seat feature 30. Accordingly, the label 50 under tension firmly presses against the outer surface of the panel 16, including the outer surface of the annular valve seat 36. At least one hole 38 is formed through the entire thickness of the panel 16 in the central recess 32. Thus, the interior of the container is in fluid communication with the central recess 32 through the hole 38.

The tension of the label 50 keeps the label in firm contact with the annular valve seat 36 as long as the gas pressure exerted through the hole 38 into the central recess 32 is low. When this pressure builds up to a high enough level, however, the resulting outward force on the label 50 pushes the label outwardly away from the annular valve seat 36 so that a flow path is formed between the label and the valve seat. In this manner, excess gas in the container is vented through the hole 38 into the central recess 32 and through the flow path between the label and valve seat, until the pressure in the container drops sufficiently that the tension of the label 50 urges the label back against the valve seat 36 to close the valve again. The degassing valve thus has a one-way function, allowing gas to be vented from the container, but substantially preventing outside air and moisture from entering through the valve into the container.

The valve seat feature 30 can also include one or more channels 40 in the outer surface of the panel 16 connecting with the annular recess 34 and extending outwardly therefrom to aid in directing the vented gas out.

To aid in sealing the valve in the closed condition, silicone oil or other viscous liquid can be applied to the outer surface of the valve seat 36 before the label is sleeved about the container body.

As noted, and with reference to FIG. 1 again, the label 50 can comprise a heat-shrink film in the form of a tubular sleeve that is initially large enough in diameter to be sleeved over the outside of the container body 12. The sleeve is then heated so that it shrinks tightly about the container body. Such heat-shrink sleeves generally have a longitudinally extending seam 54 formed by overlapping the opposite edges of the film material and sealing them together. The presence of the seam 54 can be used to advantage in the functioning of the degassing valve 22. More particularly, it is advantageous to position the heat-shrink sleeve on the container body such that the seam 54 is proximate to but spaced from the valve seat feature 30, e.g., about 10 to 20 mm (0.5 to 0.75 inch) away from the valve seat feature. The seam 54 causes the label immediately adjacent to the seam to be spaced slightly away from the outer surface of the container side wall panel 16. The seam thus can aid in allowing gas vented through the degassing valve to escape between the label and the side wall panel.

Heat-shrink films useful in the practice of the present invention can include any of various known heat-shrink films, broadly including polyolefin-based shrink films, polyester shrink films, polyamide shrink films, polystyrene shrink films, and polyvinyl chloride (PVC) shrink films.

Figure 4:
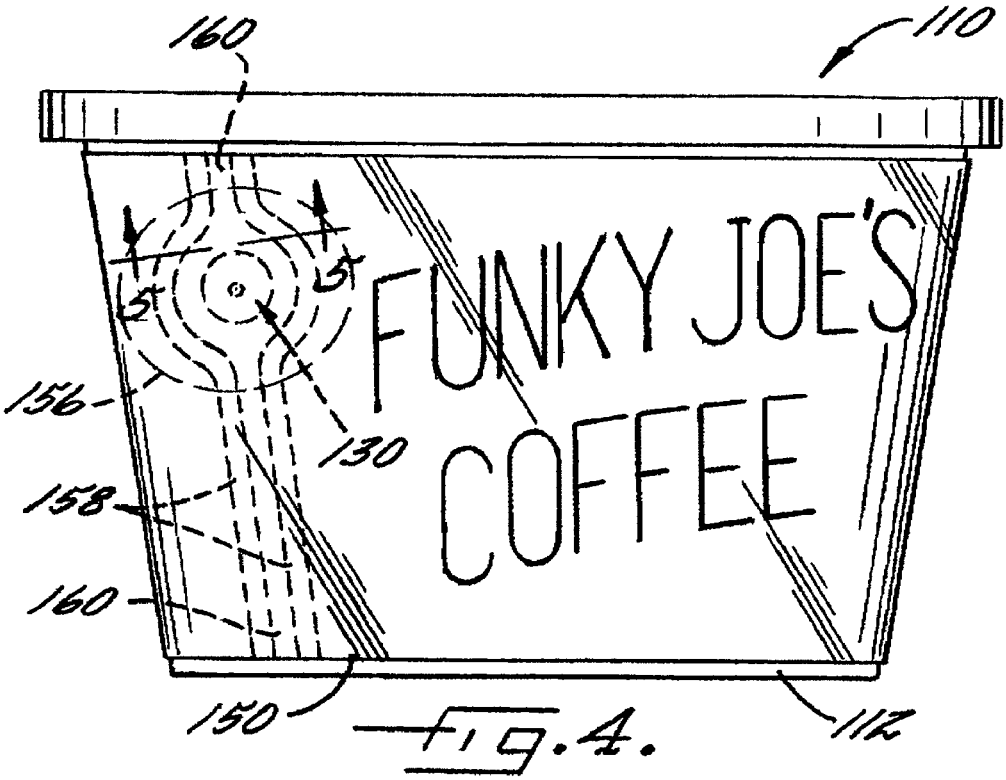
FIG. 4 is a front elevation of a container in accordance with another embodiment of the invention.
Figure 5:
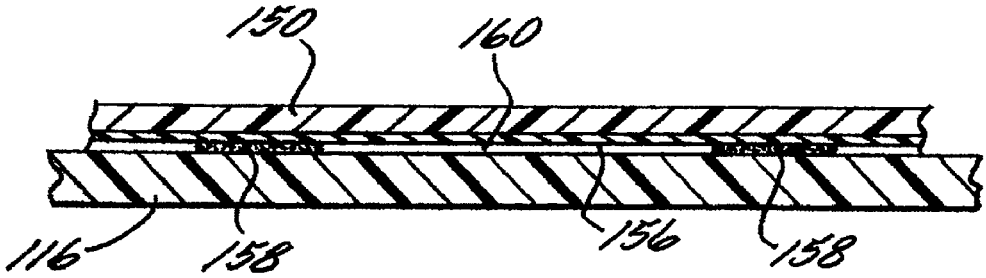
FIG. 5 is a cross-sectional view through the container along line 5-5 in FIG. 4.

A container 110 in accordance with another embodiment of the invention is shown in FIGS. 4 and 5. The container comprises a container body 112 formed by molding as previously described. The container body is in the form of a tub, as opposed to the can-style container of FIG. 1. The side wall 116 of the container body has a molded-in valve seat feature 130 (illustrated only schematically) similar to what was described above, and a label 150 is sleeved about the container body and is under tension. Unlike the previous embodiment, the label 150 includes a pattern-applied coating 156 of an oxygen barrier material applied to the label in a localized region of the label. The oxygen barrier coating 156 covers substantially less than the entire surface of the label. The oxygen barrier material has a substantially lower oxygen permeability than that of the material making up the label. The label is positioned such that the coating 156 is in registration with the valve seat feature 130. The coating 156 aids in preventing ingress of oxygen into the container through the label and degassing valve. Various oxygen barrier materials can be used, including but not limited to polyvinyl alcohol copolymer (PVOH), polyvinylidene chloride (PVDC), epoxy, ethylene vinyl alcohol copolymer (EVOH), or the like. The oxygen barrier coating 156 advantageously contacts the outer surface of the side wall 116, and can be somewhat tacky. Tackiness can improve the functioning of the degassing valve. While the region of the oxygen barrier material 156 is shown in FIG. 4 as being larger in area than the valve seat feature 130, alternatively the oxygen barrier material can cover a region approximately the same size as the valve seat feature.

Also unlike the previous embodiment, the label 150 includes a pattern-applied heat seal coating 158 on the inner surface of the label such that the heat seal coating contacts the outer surface of the container body side wall 116. The label is heat sealed to the side wall in a pattern defined by the heat seal coating 158. The pattern of the heat seal coating 158 defines one or more channels 160 between the container side wall and the label through which gas can escape. Various patterns can be used. In the illustrated embodiment of FIG. 4, the channels 160 lead to the edges of the label 150 so that gas can escape. The heat seal coating can comprise any of various heat seal materials known in the art, including but not limited to polyolefins such as polyethylene and polypropylene (in homopolymer or copolymer form), ionomers such as SURLYN® (ethylene acrylic acid ionomer), and the like.

In the various embodiments of the invention, an opening pressure of the degassing valve can be selected to be a desired value by adjusting either or both of the amount of tension in the label 50, 150 and a diameter of the valve seat feature 30, 130. In general, making the valve seat diameter larger will reduce the opening pressure, while making the diameter smaller will increase the opening pressure. Making the label tension lower will likewise reduce the opening pressure, while increasing the label tension will increase the opening pressure.

A method for making a container having a degassing valve in accordance with one embodiment of the invention comprises the steps of: (a) molding a container body 12, 112 from polymer material, the container body having a side wall 16, 116 encircling an axis and having an outer surface and an inner surface; (b) forming a valve seat feature 30, 130 in the side wall during the molding step, the valve seat feature comprising a central recess 32 in the outer surface of the side wall, an annular recess 34 in the outer surface surrounding the central recess, and an annular valve seat 36 between the central recess and the annular recess; (c) forming one or more holes 38 through the side wall in the central recess; (d) affixing a label 50, 150 against the outer surface of the side wall, the label and the valve seat feature forming the degassing valve; and (e) causing the label to be under tension that urges the label firmly against the annular valve seat 36 so as to close the degassing valve.

As noted, the molding step can comprise thermoforming, injection molding, blow molding, injection stretch-blow molding, or the like. The formation of the hole(s) through the container side wall can be performed in various ways. Advantageously, in some embodiments of the invention, a laser is used to form the hole(s). The step of affixing the label can comprise sleeving a heat-shrink sleeve about the container body, and the step of causing the label to be under tension can comprise heating the sleeve to shrink it about the container body side wall.

Figure 6:
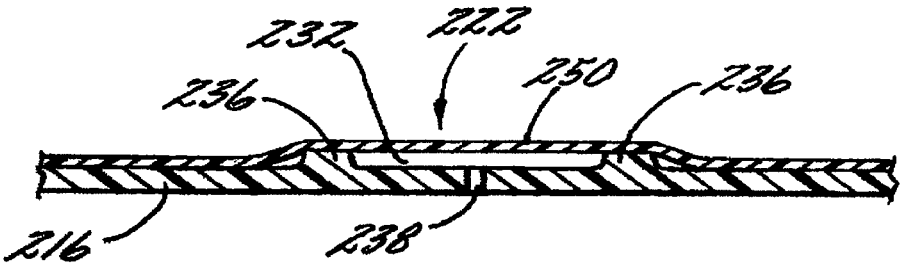
FIG. 6 is a cross-sectional view through a degassing valve in accordance with a further embodiment of the invention.

In the illustrated embodiments described thus far, the valve seat feature includes an annular recess 34 that surrounds the central recess 32, and the annular valve seat 36 is defined between the central and annular recesses. Alternatively, however, FIG. 6 shows an embodiment of a degassing valve 222 in which the side wall 216 has an annular valve seat 236 molded into the outer surface of the side wall with no annular recess surrounding the central recess 232 bounded by the valve seat. A hole 238 leads through the side wall 216 into the central recess 232. A label 250 under tension engages the annular valve seat 236. The valve 222 functions similarly to the previously described valve, and can include similar features such as silicone oil, channels in the side wall, heat-seal coatings and/or oxygen barrier coatings on the label, etc.

Many modifications and other embodiments of the inventions set forth herein will come to mind to one skilled in the art to which these inventions pertain having the benefit of the teachings presented in the foregoing descriptions and the associated drawings. For example, while the labels 50, 150 have been illustrated as tubular sleeves that completely encircle the container bodies, alternatively a label in accordance with the invention can only partially encircle the container body. For example, opposite edges of a heat-shrinkable label can be affixed to the container body by heat-sealing or other technique and the label can then be heated to shrink the label and cause the label to be in tension. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A molded plastic container having a degassing valve, comprising:

a molded rigid or semi-rigid container body comprising a side wall encircling an axis, the side wall having an outer surface and an inner surface and having a valve seat feature molded into the side wall such that the valve seat feature is integral with and of one piece with the side wall, the valve seat feature comprising a central recess in the outer surface of the side wall, and an annular valve seat surrounding the central recess;

one or more holes extending through the side wall in the central recess into the interior of the container; and a label disposed against the outer surface of the side wall such that the label is under tension, the tension of the label causing the label to firmly abut the annular valve seat, but excess pressure of gas inside the container being able to momentarily lift the label away from the annular valve seat to establish a flow path between the label and the annular valve seat such that the excess pressure is vented through the one or more holes and through the flow path, after which the tension of the label causes the label to reengage the annular valve seat to close the degassing valve.

2. The molded plastic container of claim 1, wherein the valve seat feature further comprises an annular recess in the outer surface of the side wall surrounding the central recess, the annular valve seat being defined between the central recess and the annular recess.

3. The molded plastic container of claim 1, further comprising silicone oil disposed between the label and the valve seat feature to aid in sealing the degassing valve.

4. The molded plastic container of claim 1, wherein at least that portion of the label overlying the valve seat feature includes an oxygen barrier material.

5. The molded plastic container of claim 1, wherein the label includes a pattern-applied coating of an oxygen barrier material that covers less than the entire surface of the label and that is in registration with the valve seat feature.

6. The molded plastic container of claim 5, wherein the coating of the oxygen barrier material is on an inner surface of the label such that the oxygen barrier material contacts the outer surface of the side wall, and wherein the oxygen barrier material is tacky.

7. The molded plastic container of claim 5, wherein the oxygen barrier material comprises polyvinyl alcohol copolymer.

8. The molded plastic container of claim 5, wherein the oxygen barrier material comprises polyvinylidene chloride.

9. The molded plastic container of claim 1, wherein the label includes a pattern-applied coating of a heat-sealable material in registration with the valve seat feature, the heat-sealable material being heat-sealed to the outer surface of the side wall so as to form one or more channels for guiding the gas vented from the container.

10. The molded plastic container of claim 1, wherein the label is a heat-shrunk sleeve comprising a heat-shrinkable polymer film, the label encircling the side wall of the container body.

11. The molded plastic container of claim 10, wherein the heat-shrunk sleeve has a longitudinally extending seam and is positioned about the side wall such that the seam is proximate to but circumferentially spaced from the valve seat feature.

12. The molded plastic container of claim 1, wherein the valve seat feature includes one or more channels in the outer surface of the side wall leading radially outward from the annular valve seat.

13. The molded plastic container of claim 1, wherein the container body has a bottom wall molded with the side wall as a one-piece molded plastic structure.

14. The molded plastic container of claim 1, wherein the side wall has a non-round cross-sectional shape.

15. A label for a container, comprising:

a label substrate having opposite surfaces, each of the opposite surfaces having a surface area delimited by edges of the label substrate; and a coating of an oxygen barrier material applied to one of the opposite surfaces of the label substrate, the coating covering an area substantially less than said surface area, the oxygen barrier material having a substantially lower oxygen permeability than that of the material making up the label substrate.

16. The label of claim 15, wherein the label substrate comprises a heat-shrinkable polymer film.

17. The label of claim 16, wherein the label is in the form of a tubular sleeve having a radially inner surface and a radially outer surface.

18. The label of claim 17, wherein the coating of the oxygen barrier material is applied to the radially inner surface of the sleeve.

19. The label of claim 18, wherein the oxygen barrier material is tacky for adhering to an outer surface of a container about which the sleeve is positioned.

* * * * *